US012173901B2

(12) United States Patent
Ryon et al.

(10) Patent No.: US 12,173,901 B2
(45) Date of Patent: Dec. 24, 2024

(54) LINE REPLACEABLE FUEL INJECTOR PANELS

(71) Applicant: Collins Engine Nozzles, Inc., Des Moines, IA (US)

(72) Inventors: Jason A. Ryon, Carlisle, IA (US); Brandon P. Williams, Johnston, IA (US)

(73) Assignee: Collins Engine Nozzles, Inc., Des Moines, IA (US)

( * ) Notice: Subject to any disclaimer, the term of this patent is extended or adjusted under 35 U.S.C. 154(b) by 0 days.

(21) Appl. No.: 18/109,637

(22) Filed: Feb. 14, 2023

(65) Prior Publication Data

US 2024/0271787 A1 Aug. 15, 2024

(51) Int. Cl.
*F23R 3/60* (2006.01)
*F23R 3/28* (2006.01)

(52) U.S. Cl.
CPC ..... *F23R 3/28* (2013.01); *F23R 3/283* (2013.01)

(58) Field of Classification Search
CPC .. F23R 3/002; F23R 3/28; F23R 3/283; F23R 3/50; F23R 2900/00017
See application file for complete search history.

(56) References Cited

U.S. PATENT DOCUMENTS 8,943,835 B2 * 2/2015 Corsmeier ..... F23R 3/007 60/753
9,612,017 B2 4/2017 Vetters
10,386,071 B2 * 8/2019 Strzepek ..... F23R 3/46
10,816,207 B2 * 10/2020 Fryer ..... F23R 3/283
10,830,442 B2 11/2020 Berry et al.
11,131,458 B2 9/2021 Prociw et al.
11,408,609 B2 8/2022 Prociw et al.
11,480,337 B2 10/2022 Prociw et al.
2008/0092541 A1 4/2008 Palmer
2008/0092547 A1 4/2008 Lockyer et al.
(Continued)

FOREIGN PATENT DOCUMENTS

EP 3130854 A1 2/2017

OTHER PUBLICATIONS

Partial Search Report from European Application No. 24157182.7, Dated Jul. 4, 2024, 12 pages.
(Continued)

*Primary Examiner* — Gerald L Sung
*Assistant Examiner* — Sean V Meiller
(74) *Attorney, Agent, or Firm* — Kinney & Lange, P.A.

(57) ABSTRACT

A system includes an engine case for a gas turbine engine defined around a longitudinal axis. A combustor is housed in the space inside the engine case. The combustor includes an inner annular wall and an outer annular wall radially outboard from the inner annular wall. The inner annular wall includes a first rail on an upstream end thereof with a radially outward opening slot. The outer annular wall includes a second rail on an upstream end thereof. The combustor includes a plurality of circumferentially spaced apart dome liners extending from the first rail to the second rail. A plurality of fuel injector components can be assembled across the first and second rails to form a combustor dome together with the dome liners at an upstream end of a combustion space defined between the inner and outer annular walls of the combustor.

16 Claims, 5 Drawing Sheets

(56) References Cited

U.S. PATENT DOCUMENTS

| | | | | |
|---|---|---|---|---|
| 2009/0277185 | A1* | 11/2009 | Goeke | F02C 9/263 60/776 |
| 2011/0030377 | A1 | 2/2011 | Lockyer et al. | |
| 2013/0340437 | A1 | 12/2013 | Erbas-Sen et al. | |
| 2022/0195930 | A1 | 6/2022 | Ryon et al. | |

OTHER PUBLICATIONS

Extended European Search Report from European Application No. 24157182.7, Dated Sep. 25, 2024, 11 pages.

* cited by examiner

LINE REPLACEABLE FUEL INJECTOR PANELS

BACKGROUND

1. Field

The present disclosure relates to fuel injection and combustion systems, and more particularly to fuel injection and combustion systems for gas turbine engines.

2. Description of Related Art

Fuel injectors can be line replaceable. However, the typical line replaceable fuel injector requires the mechanical load to be carried by the engine case. This results in a large cantilevered mass, and therefore requires substantial strength in the flange and feedarm to be strong enough to prevent fatigue.

In addition, the fuel injector requires burner seals to allow for axial and radial movement caused by a mismatch due to differential thermal expansion between the combustor and the engine case. This can allow air to leak between injector and dome, can reduce the amount of thermal cooling on the dome, and can be a fretting point between the injector and burner seals.

The conventional techniques have been considered satisfactory for their intended purpose. However, there is an ever present need for improved systems and methods for line replaceable fuel injectors. This disclosure provides a solution for this need.

SUMMARY

A system includes an engine case for a gas turbine engine defined around a longitudinal axis, wherein a plurality of access openings are defined through the engine case for access from outside the engine case to a space inside the engine case. A combustor is housed in the space inside the engine case. The combustor includes an inner annular wall and an outer annular wall radially outboard from the inner annular wall. The inner annular wall includes a first rail on an upstream end thereof with a radially outward opening slot. The outer annular wall includes a second rail on an upstream end thereof. The combustor includes a plurality of circumferentially spaced apart dome liners extending from the first rail to the second rail.

A plurality of fuel injector components can be assembled across the first and second rails to form a combustor dome together with the dome liners at an upstream end of a combustion space defined between the inner and outer annular walls of the combustor. Each access opening of the engine case and the fuel injector components can be configured so that the access opening is wide enough in a circumferential direction relative to the longitudinal axis to admit only one of the fuel injector components therethrough. Each access opening of the engine case can be covered by a radially outward flange of a respective one of the fuel injector components. Each of the fuel injector components can include an inner edge configured to seat in the radially outward opening slot. Each of the fuel injector components can include an outer edge configured to seat against the second rail. The radially outer edge of the combustor dome plate of each of the fuel injector components in the plurality of fuel injector components can be captured axially between the second rail on an axially downstream side and two of the dome liners on an axially upstream side.

Each fuel injector component in the plurality of fuel injector components can include a combustor dome plate extending from a radially inner edge to a radially outer edge and extending circumferentially from a first side edge to a second side edge. A fuel injector can be defined through the combustor dome plate. The fuel injector can include passages for air and fuel injection into the combustion space.

Each fuel injector component in the plurality of fuel injector components can include a fuel tube extending radially outward from the fuel injector for fluid communication of fuel from an external source into the injector. The fuel tube can pass through a radially outward flange of the fuel injector component configured to mount the fuel injector component to the engine case. The fuel tube can include a coiled section and a fuel inlet fitting for connection of the final fuel injector component to an external fuel manifold. The external fuel manifold can include a respective connection branch configured to connect to the fuel tube of each of the fuel injector components. Each fuel injector component in the plurality of fuel injector components can include a heat shield extending around the fuel tube from a radially outward flange to the fuel injector.

Each fuel injector component in the plurality of fuel injector components can further include a plurality of additional fuel injectors defined through the combustor dome plate and including passages for air and fuel injection in to the combustion space. A fuel tube can extend radially outward from the first fuel injector for fluid communication of fuel from an external source into the first injector. There can be a plurality of fuel tube branches, each of the plurality of fuel tube branches connecting from the first fuel injector to a respective one of the plurality of additional fuel injectors for fluid communication from the first fuel injector to each of the additional fuel injectors.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
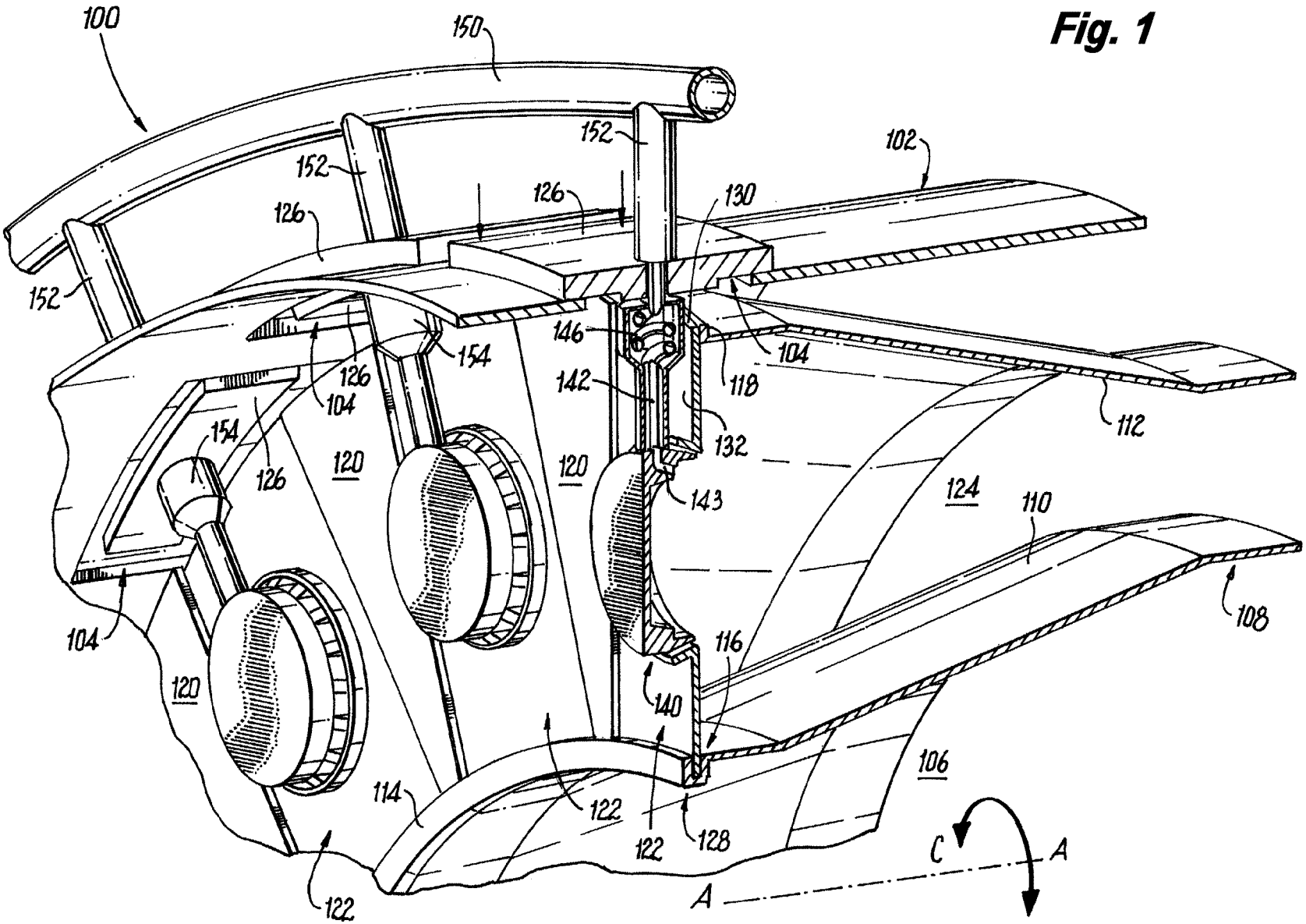
FIG. 1 is a schematic perspective view of an embodiment of a system constructed in accordance with the present disclosure, showing the engine case and combustor.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-5, as will be described. The systems and methods described herein can be used to provide line replaceable fuel injector components for single-point or multi-point injection configurations.

The system 100 includes an engine case 102 for a gas turbine engine defined around a longitudinal axis A, wherein a plurality of access openings 104 are defined through the engine case 102 for access from outside the engine case 102 to a space 106 inside the engine case 102. A combustor 108 is housed in the space 106 inside the engine case 102. The combustor 108 includes an inner annular wall 110 and an outer annular wall 112 radially outboard from the inner annular wall 110. The inner annular wall 110 includes a first rail 114 on an upstream end thereof with a radially outward opening slot 116. The outer annular wall 112 includes a second rail 118 on an upstream end thereof. The combustor 108 includes a plurality of circumferentially spaced apart dome liners 120 extending from the first rail 114 to the second rail 118.

A plurality of fuel injector components 122 are assembled across the first and second rails 114, 118 to form a combustor dome together with the dome liners 120 at an upstream end of a combustion space 124 defined between the inner and outer annular walls 110, 112 of the combustor 108. Each access opening 104 of the engine case 102 and the fuel injector components 122 are configured so that the access opening 104 is wide enough in a circumferential direction C relative to the longitudinal axis A to admit only one of the fuel injector components 122 therethrough. Each access opening 104 of the engine case 102 is covered by a radially outward flange 126 of a respective one of the fuel injector components 122, e.g. with flange bolts indicated by the arrows in FIG. 1. Each of the fuel injector components 122 includes an inner edge 128 configured to seat in the radially outward opening slot 116. Each of the fuel injector components 122 includes an outer edge 130 configured to seat against the second rail 118. The radially outer edge 130 of the combustor dome plate 132 of each of the fuel injector components 122 is captured axially between the second rail 118 on an axially downstream side and two of the dome liners 120 on an axially upstream side.

Figure 2:
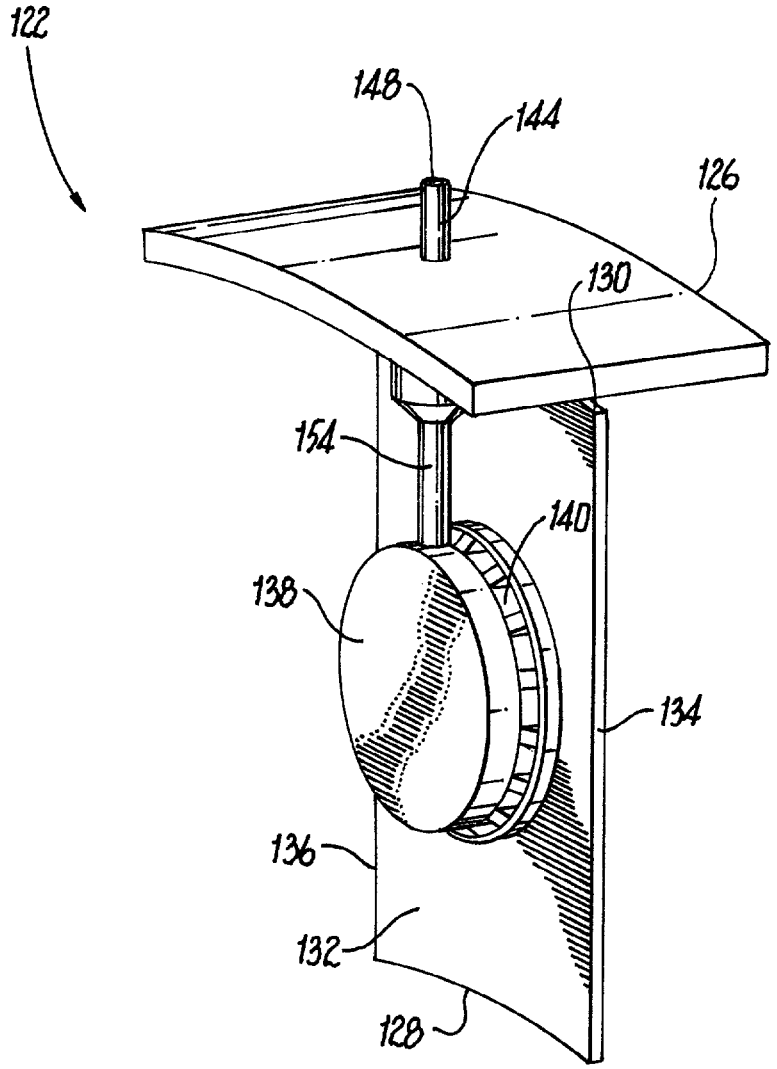
FIG. 2 is a schematic perspective view of a portion of the system of FIG. 1, showing one of the fuel injector components, from upstream.
Figure 3:
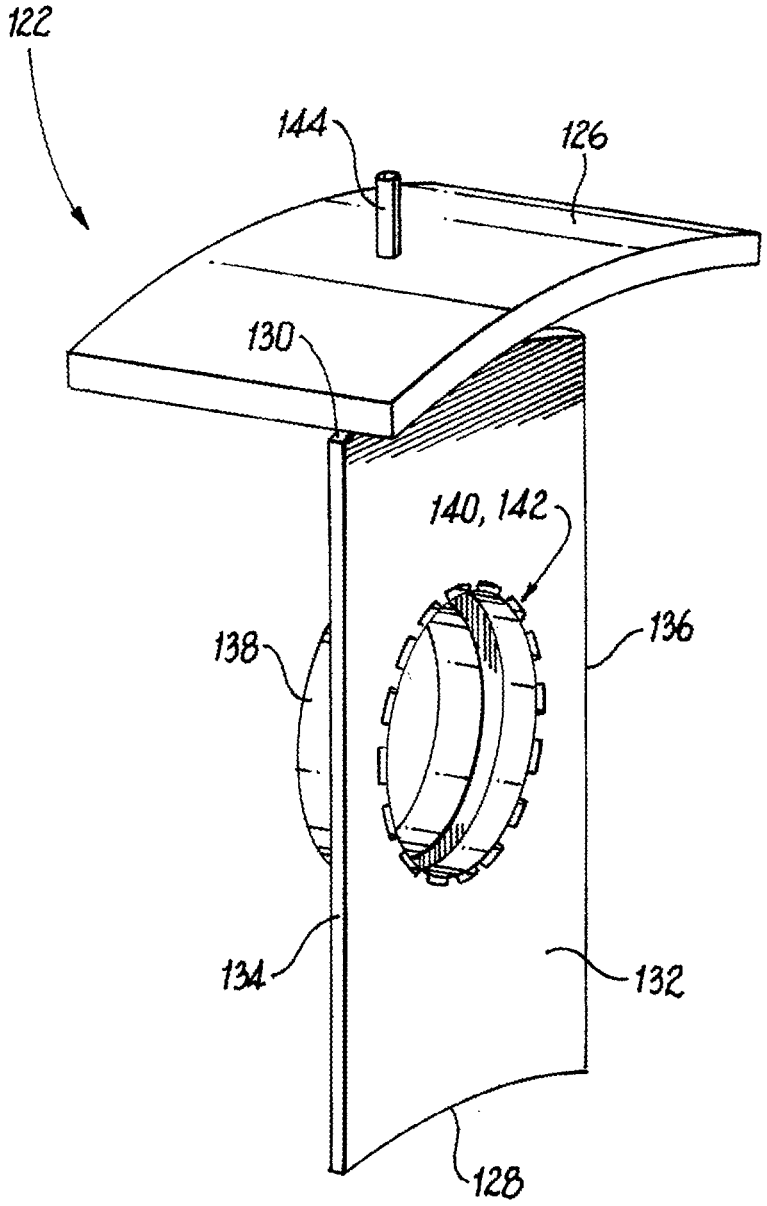
FIG. 3 is a schematic perspective view of the fuel injector component of FIG. 2, from downstream.

With reference now to FIGS. 2-3, each fuel injector component 122 is configured as a line replaceable unit (LRU) and includes a combustor dome plate 132 extending from the radially inner edge 128 to the radially outer edge 130 and extending circumferentially from a first side edge 134 to a second side edge 136. A fuel injector 138 is defined through the combustor dome plate 132. The fuel injector 138 includes passages 140 for air and passages 143 for fuel (labeled in FIG. 1), for fuel injection into the combustion space 124 of FIG. 1. FIG. 2 shows the fuel injector component 122 from the upstream side as in FIG. 1, and FIG. 3 shows the fuel injector component 122 from the downstream side.

Each fuel injector component 122 includes at least one fuel tube 144 extending radially outward from the fuel injector 138 for fluid communication of fuel from an external source into the injector 138. In applications that involve staging different fuel circuits more than one fuel tube 144 can be included in parallel with each other. The fuel tube 144 passes through the radially outward flange 126 of the fuel injector component 122. The radially outward flange 126 is configured to mount the fuel injector component 122 to the engine case 102 as shown in FIG. 1, so the stress of supporting injector 138 is born by the engine case 102. The fuel tube 144 includes a coiled section 146, labeled in FIG. 1, for accommodating thermal expansion and contraction. A fuel inlet fitting 148 is included at the end of the fuel tube 144 for connection of the final fuel injector component 122 to an external fuel manifold 150, labeled in FIG. 1, e.g. the connection to the fuel manifold 150 can be by brazing, welding, threading, or the like. The external fuel manifold 150 includes a respective connection branch 152 configured to connect to the fuel tube 142 of each of the fuel injector components. A heat shield 154 extends around the fuel tube 142 from a radially outward flange 126 to the fuel injector 138.

Figure 4:
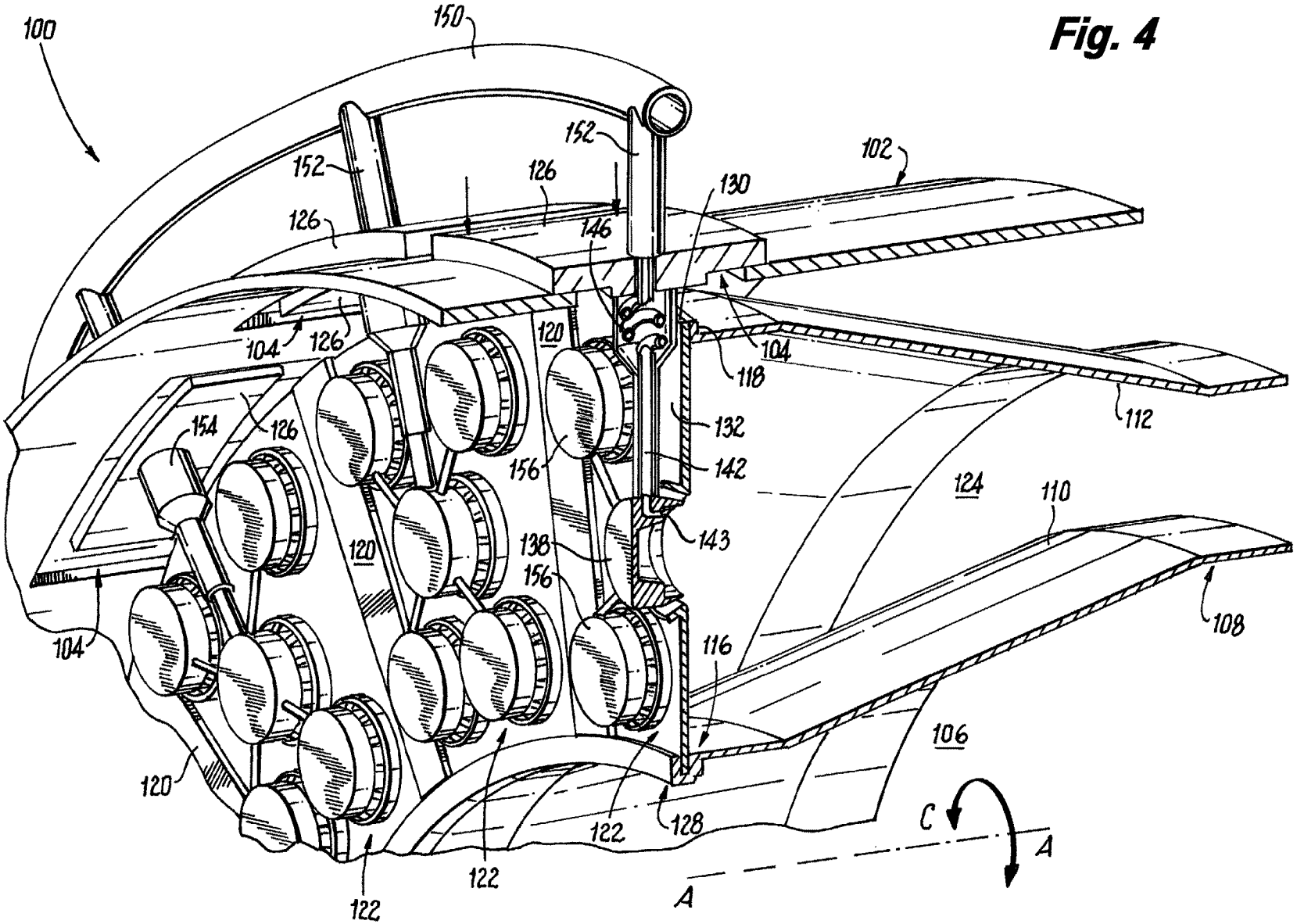
FIG. 4 is a schematic perspective view of an embodiment of a system constructed in accordance with the present disclosure, showing the engine case and combustor with multipoint fuel injector components.
Figure 5:
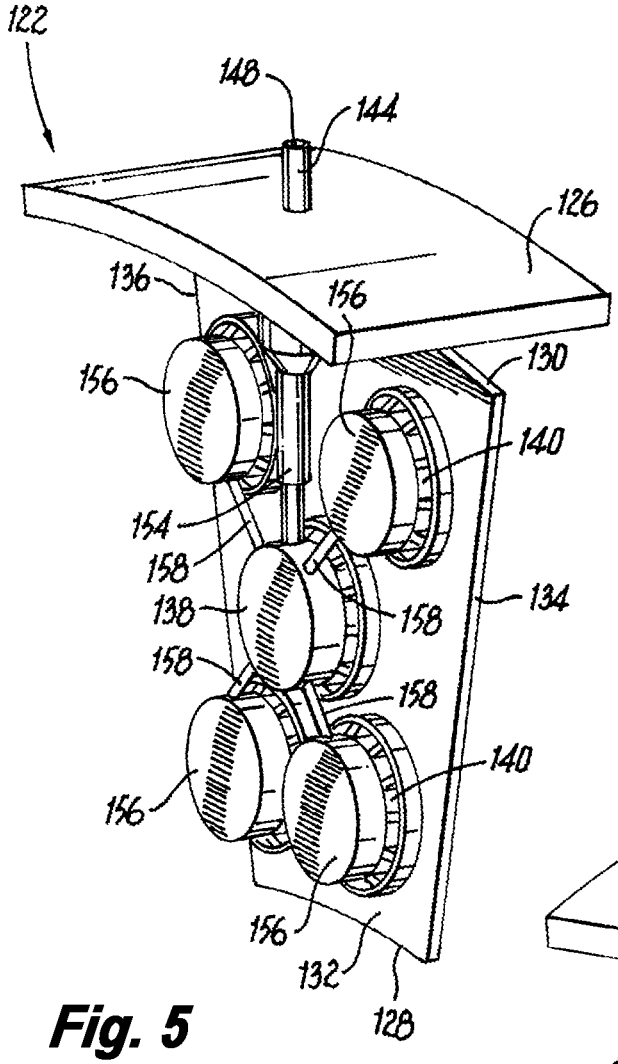
FIG. 5 is a schematic perspective view of one of the multipoint fuel injector components of FIG. 4, from upstream.
Figure 6:
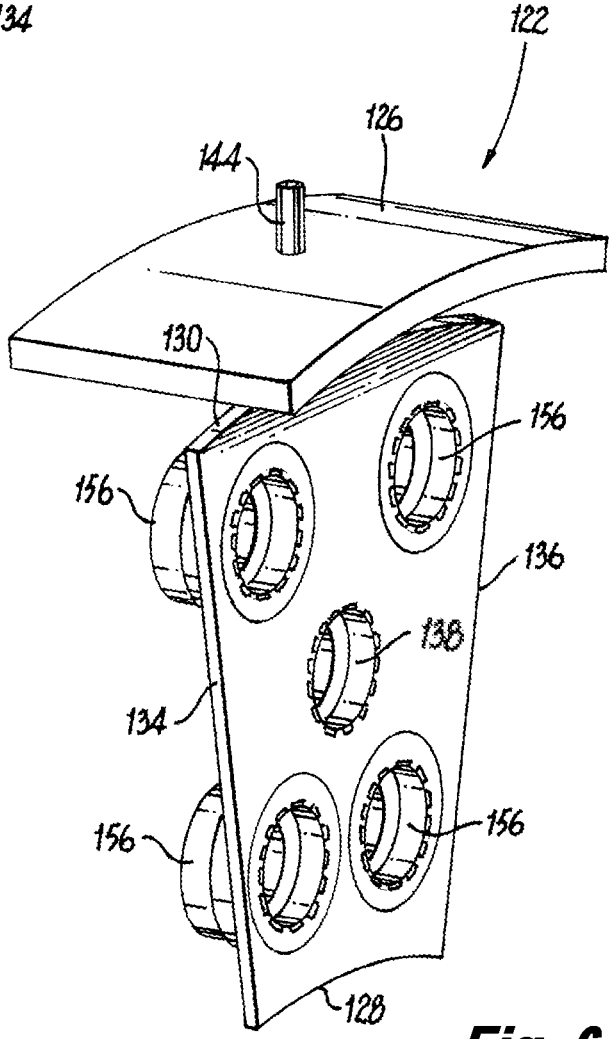
FIG. 6 is a schematic perspective view of the multipoint fuel injector component of FIG. 5, from downstream.

The configuration of FIGS. 1-3 is for single point injection, however with reference now to FIGS. 4-6, another configuration is shown for multipoint fuel injection. The fuel injector components 122 in FIGS. 4-6 each include multiple injectors 138, 156. A plurality of additional fuel injectors 156 are defined through the combustor dome plate 132 and including passages for air and fuel injection in to the combustion space 124 much as those described above for the injector 156 of FIG. 1. The fuel tube (or tubes) 142 extends radially outward from the first fuel injector 138 for fluid communication of fuel from an external source into the first injector 138. A plurality of fuel tube branches 158, each of the plurality of fuel tube branches 158 connecting from the first fuel injector 138 to a respective one of the plurality of additional fuel injectors 156 for fluid communication from the first fuel injector 138 to each of the additional fuel injectors 156. FIG. 5 shows the fuel injector component 122 from the upstream side as in FIG. 4, and FIG. 6 shows the fuel injector component 122 from the downstream side. FIG. 4 shows the system 100 with the fuel injector components assembled to form the combustor dome with the dome liners 120, much as in FIG. 1 but for multipoint fuel injection. Those skilled in the art having had the benefit of this disclosure will readily appreciate that while FIGS. 4-6 only show 3 radial rows of injectors 138, 156, any suitable number of radial rows can be used, e.g. 4 or 5 rows or more. The injectors 138, 156 form a circumferential pattern that is two injectors 138, 156 wide in the circumferential direction C, i.e. the pattern repeats every two injectors 138, 156 in the circumferential direction C, however any other suitable pattern can be used, e.g. where there are more than two circumferential rows of injectors 138, 156 in the repeating pattern.

Systems and methods as disclosed herein provide potential benefits including the following. Systems and methods as disclosed herein can provide a way of supporting the fuel injector in which the injector is integrated into a dome panel, and the dome panels sit within and are supported by a combustor frame. This can distribute the stress load between the case and the combustor and can remove the need for burner seals.

The methods and systems of the present disclosure, as described above and shown in the drawings, provide for line replaceable fuel injector components for single-point or multi-point injection configurations. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising: an engine case for a gas turbine engine defined around a longitudinal axis, wherein a plurality of access openings are defined through the engine case for access from outside the engine case to a space inside the engine case; a combustor housed in the space inside the engine case, wherein the combustor includes an inner annular wall and an outer annular wall radially outboard from the inner annular wall, wherein the inner annular wall includes a first rail on an upstream end thereof with a radially outward opening slot, wherein the outer annular wall includes a second rail on an upstream end thereof, and wherein the combustor includes a plurality of circumferentially spaced apart dome liners extending from the first rail to the second rail; and a plurality of fuel injector components assembled across the first and second rails to form a combustor dome together with the dome liners at an upstream end of a combustion space defined between the inner and outer annular walls of the combustor, each of the fuel injector components includes an inner edge configured to seat against the first rail and outer edge configured to seat against the second rail to form a portion of the dome, wherein each of the plurality of fuel injectors components are configured to be removed individually from the engine case through each access opening, and wherein each access opening of the engine case and the fuel injector components are configured so that the access opening is wide enough in a circumferential direction relative to the longitudinal axis to admit only one of the fuel injector components therethrough.

2. The system as recited in claim 1, wherein each access opening of the engine case is covered by a radially outward flange of a respective one of the fuel injector components.

3. The system as recited in claim 1, wherein each fuel injector component in the plurality of fuel injector components includes:

a combustor dome plate extending from a radially inner edge to a radially outer edge and extending circumferentially from a first side edge to a second side edge; and a fuel injector defined through the combustor dome plate, the fuel injector including passages for air and fuel injection into the combustion space.

4. The system as recited in claim 3, wherein each fuel injector component in the plurality of fuel injector components includes:

a fuel tube extending radially outward from the fuel injector for fluid communication of fuel from an external source into the injector.

5. The system as recited in claim 4, wherein the fuel tube passes through a radially outward flange of the fuel injector component configured to mount the fuel injector component to the engine case.

6. The system as recited in claim 4, wherein each fuel injector component in the plurality of fuel injector components includes the fuel tube, wherein the fuel tube includes a coiled section and a fuel inlet fitting for connection of the final fuel injector component to an external fuel manifold.

7. The system as recited in claim 6, further comprising the external fuel manifold with a respective connection branch configured to connect to the fuel tube of each of the fuel injector components.

8. The system as recited in claim 6, wherein each fuel injector component in the plurality of fuel injector components includes a heat shield extending around the fuel tube from a radially outward flange to the fuel injector.

9. The system as recited in claim 3, wherein the radially outer edge of the combustor dome plate of each of the fuel injector components in the plurality of fuel injector components is captured axially between the second rail on an axially downstream side and two of the dome liners on an axially upstream side.

10. The system as recited in claim 3, wherein the fuel injector of each of the fuel injector components of the plurality of fuel injector components is a first fuel injector, wherein each fuel injector component in the plurality of fuel injector components further includes a plurality of additional fuel injectors defined through the combustor dome plate and including passages for air and fuel injection in to the combustion space.

11. The system as recited in claim 10, wherein each fuel injector component in the plurality of fuel injector components includes:

a fuel tube extending radially outward from the first fuel injector for fluid communication of fuel from an external source into the first injector; and a plurality of fuel tube branches, each of the plurality of fuel tube branches connecting from the first fuel injector to a respective one of the plurality of additional fuel injectors for fluid communication from the first fuel injector to each of the additional fuel injectors.

12. A fuel injector component comprising: a combustor dome plate extending from a radially inner edge to a radially outer edge and extending circumferentially from a first side edge to a second side edge, and configured so that an access opening in an engine case for a gas turbine engine into a combustor is wide enough in a circumferential direction relative to the longitudinal axis to admit only the fuel injector component including the combustor dome plate therethrough; and at least one fuel injector defined through the combustor dome plate, the at least one fuel injector including passages for air and fuel injection into the combustion space, wherein the fuel injector component is configured to be inserted through an the access opening in an engine case for a gas turbine engine into a combustor housed in the space inside the engine case, and the access opening of the engine case and the fuel injector component are configured so that the access opening is wide enough only in a circumferential direction relative to the longitudinal axis to admit only the fuel injector component therethrough, wherein the combustor includes an inner annular wall and an outer annular wall radially outboard from the inner annular wall, wherein the inner annular wall includes a first rail on an upstream end thereof with a radially outward opening slot configured to receive the radially inner edge, wherein the outer annular wall includes a second rail on an upstream end thereof configured to receive the radially outer edge.

13. The fuel injector component as recited in claim 12, further comprising a fuel tube extending radially outward from the at least one fuel injector for fluid communication of fuel from an external source into the injector.

14. The fuel injector component as recited in claim 13, wherein the fuel tube passes through a radially outward flange of the fuel injector component configured to mount the fuel injector component to an engine case.

15. The fuel injector component as recited in claim 13, wherein the fuel tube includes a coiled section and a fuel inlet fitting for connection of the final fuel injector component to an external fuel manifold.

16. The fuel injector component as recited in claim 13, further comprising a heat shield extending around the fuel tube from a radially outward flange to the fuel injector.

* * * * *